US007370368B2

(12) United States Patent
Motooka et al.

(10) Patent No.: US 7,370,368 B2
(45) Date of Patent: May 13, 2008

(54) CATCHING TOOL FOR BASEBALL OR SOFTBALL

(75) Inventors: Ken Motooka, Osaka (JP); Kazunori Ayama, Osaka (JP); Norifumi Ito, Osaka (JP); Masaki Terashita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 11/412,402

(22) Filed: Apr. 27, 2006

(65) Prior Publication Data

US 2006/0272068 A1 Dec. 7, 2006

(30) Foreign Application Priority Data

Jun. 2, 2005 (JP) ..... 2005-162208
Apr. 12, 2006 (JP) ..... 2006-109344

(51) Int. Cl.
*A63B 71/14* (2006.01)

(52) U.S. Cl. ..... 2/19; 2/161.1; 2/21

(58) Field of Classification Search ..... 2/19, 2/21, 161.1, 163, 164
See application file for complete search history.

(56) References Cited

U.S. PATENT DOCUMENTS 2,778,023 A 1/1957 Tompkins
4,665,561 A 5/1987 Aoki
4,896,376 A * 1/1990 Miner ..... 2/19
5,031,239 A 7/1991 Panichello et al.
5,717,995 A 2/1998 Murai
6,430,745 B2 * 8/2002 Murai ..... 2/19
6,640,339 B1 * 11/2003 Gilligan ..... 2/19
6,681,401 B1 1/2004 Marino

FOREIGN PATENT DOCUMENTS

| | | |
|---|---|---|
| JP | 07-037657 | 8/1995 |
| JP | 08-117383 | 5/1996 |
| JP | 10-043352 | 2/1998 |
| JP | 11-313914 | 11/1999 |
| JP | 2006-034737 | 2/2006 |

* cited by examiner

*Primary Examiner*—Gary L. Welch
*Assistant Examiner*—Alissa J Tompkins
(74) *Attorney, Agent, or Firm*—Troutman Sanders, LLP; James E. Schutz

(57) ABSTRACT

In a catching tool for baseball or softball, a lining leather including at least a back-side leather and a palm-side leather is inserted into a surface leather including at least a back leather and a ball-receiving leather, and the lining leather has inner-side finger stalls defined by peripheral edges of the back-side leather and the palm-side leather which are sewn together. A finger part stabilizing member is provided along at least a region on right and left sides in a region covering a root part through a fingertip part of a wearer's finger inside the inner-side finger stall. The finger part stabilizing member is provided in at least one of the inner-side finger stalls, which are an inner-side thumb stall, an inner-side forefinger stall, an inner-side middle finger stall, an inner-side fourth finger stall, and an inner-side little finger stall.

1 Claim, 6 Drawing Sheets

CATCHING TOOL FOR BASEBALL OR SOFTBALL

This non-provisional application is based on Japanese Patent Applications Nos. 2005-162208 and 2006-109344 filed with the Japan Patent Office on Jun. 2, 2005 and Apr. 12, 2006, respectively, the entire contents of which are hereby incorporated by reference.

BACKGROUND OF THE INVENTION

1. Field of the Invention

The present invention relates to a catching tool for baseball or softball, and more particularly to a catching tool for baseball or softball that realizes an improved holding property and a sense of fitting by providing the catching tool with a finger part stabilizing member.

2. Description of the Background Art

Conventionally, fingers inserted into a catching tool for baseball or softball (hereinafter, may be referred to as a glove) are generally secured when the fingers are inserted into inner-side finger stalls provided in an inner leather (an inner-side thumb stall, an inner-side forefinger stall, a middle finger stall, an inner-side fourth finger stall, and an inner-side little finger stall). However, the respective inner-side finger stalls are generally formed in a size significantly larger than an actual size of the hand. Therefore, it is not possible for the catching tool to give the fitting sense in the same manner as when inserting the hands in commonly worn gloves, and the catching tool can only loosely fit the fingers in the presence of a certain degree of space in an entire periphery of the fingers. In terms of a movement of the glove when a ball is thereby caught, the presence of the space allows the glove to be closed. However, it may be necessary in some cases for the glove to appropriately fit the forefinger and the middle finger so that an impact from the ball when the ball is caught and forces of the fingers exerted when the ball is grabbed can be efficiently transmitted to the glove.

In order to solve the foregoing problem, Japanese Utility Model Publication No. 07-037657 discloses a glove in which a palm part, a thumb part, a forefinger part, a middle finger part, a fourth finger part and a little finger part are integrally formed in a thick lining leather, stalls are formed in such a manner that end parts of two thin leathers are sewn to back-surface end parts of the forefinger part, middle finger part and fourth finger part, cushion members are inserted into the respective stalls, and an end part of a thin leather is sewn to back-surface end parts of the thumb part and the little finger part.

However, the glove disclosed in Japanese Utility Model Publication No. 07-037657 is provided with the cushion members on only the back-surface parts of the respective fingers, and therefore, the catching tool fails to fit the finger and the finger cannot be thereby appropriately held in right and left side parts thereof

SUMMARY OF THE INVENTION

Therefore, an object of the present invention is to provide a catching tool provided with a finger part stabilizing member in at least one of inner-side finger stalls thereof so that the catching tool can better fit a finger and the finger can be thereby more appropriately held in order to smoothly transmit a force from a hand to the catching tool, and an impact from a ball when the ball is caught can be alleviated.

Another object of the present invention is to provide a catching tool capable of smoothly transmitting the force from the hand to the catching tool in such a manner that the catching tool can better fit the finger and the finger can be thereby more appropriately held.

A catching tool for baseball or softball according to an aspect of the present invention is characterized in that a lining leather including at least a back-side leather and a palm-side leather is inserted into a surface leather including a back leather and a ball-receiving leather, the lining leather has inner-side finger stalls defined by peripheral edges of the back-side leather and the palm-side leather which are sewn together, and a finger part stabilizing member to be applied to a region including at least a palm side and right and left sides in a region covering a root part through a fingertip part of the wearer's finger is provided in at least one of the inner-side finger stalls, which are an wearer's finger is provided in at least one of the inner-side finger stalls, which are an inner-side thumb stall, an inner-side forefinger stall, an inner-side middle finger stall, an inner-side fourth finger stall, and an inner-side little finger stall.

In the catching tool for baseball or softball according to the above aspect of the present invention, the finger part stabilizing member is provided inside the inner-side finger stall in a main body of the catching tool so that the catching tool can better fit the finger and the finger can be thereby appropriately held. Therefore, the force can be smoothly transmitted from the hand to the catching tool. As a secondary effect, the impact from the ball when the ball is caught can be alleviated.

The finger part stabilizing member can be provided so that it can be applied to at least a part of a back-of-hand side of the finger in addition to the region including the palm side and the right and left sides in the region covering the root part of the finger through the fingertip part, or can be provided so that a part to be applied to the wearer's palm part can be included therein.

A catching tool for baseball or softball according to another aspect of the present invention includes a surface leather produced in such a manner that a back leather and a ball-receiving leather are joined with each other, a lining leather inserted into the surface leather, produced in such a manner that a back-side leather and a palm-side leather are joined with each other and having at least one finger stall into which a wearer's finger can be inserted, and a finger part stabilizing member provided in the inner leather to reach into the finger stall and having a pair of wall parts formed on both sides of the wearer's finger when the wearer's finger is inserted into the finger stall.

In the catching tool for baseball or softball according to the another aspect of the present invention, the finger part stabilizing member having the pair of wall parts formed on the both sides of the wearer's finger when the wearer's finger is inserted into the finger stall is provided. Therefore, the catching tool can better fit the wearer's finger and the finger can be thereby more appropriately held, and the force can be smoothly transmitted from the hand to the catching tool. invention will become more apparent from the following detailed description of the present invention when taken in conjunction with the accompanying drawings.

DESCRIPTION OF THE PREFERRED EMBODIMENTS

Figure 14:
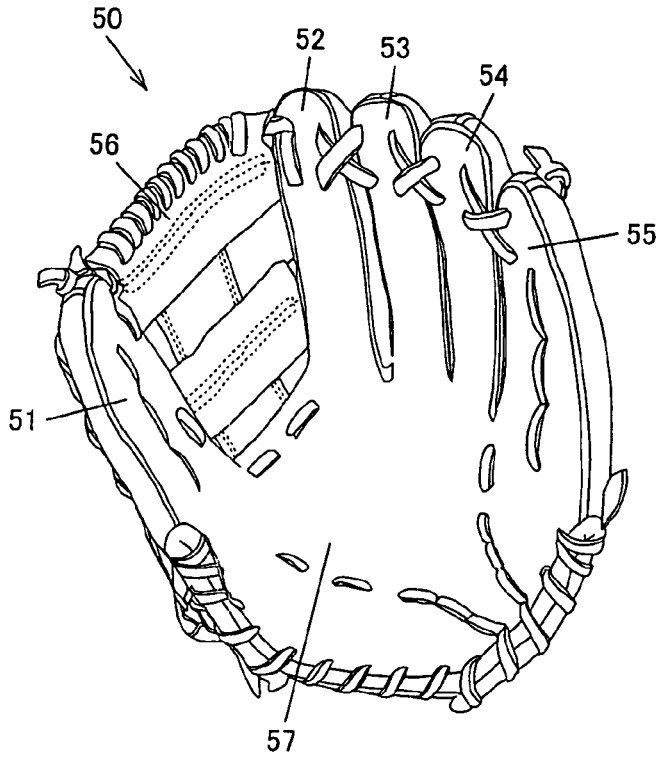
FIG. 14 is a front view of a catching tool according to the example of the present invention.
Figure 15:
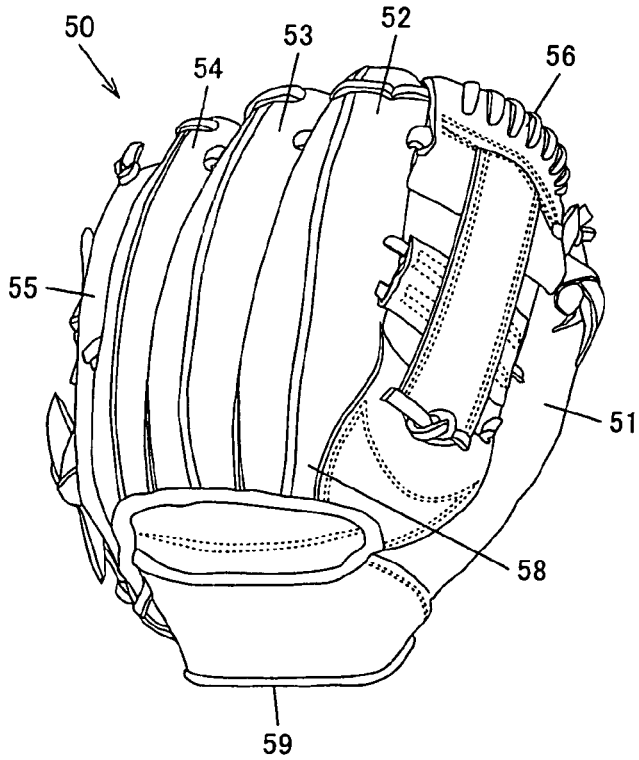
FIG. 15 is a rear view of the catching tool according to the example of the present invention.

Hereinafter, a preferred embodiment of the present invention is described. A main body of a glove according to the present invention has a constitution basically the same as that of a main body of a conventional glove. More specifically, the main body of the glove includes a surface leather constituting a surface of the glove and a lining leather inserted into the surface leather and constituting an inner side of the glove. The surface leather includes at least a back leather 58 and a ball-receiving leather 57, and the lining leather includes at least a back-side leather and a palm-side leather as shown in FIGS. 14 and 15.

The back leather is obtained in such a manner that parts formed from a plurality of leathers are sewn so that five finger stalls are formed, and the ball-receiving leather is formed in a substantially five-finger shape. The surface leather is obtained in such a manner that peripheral edges of ball-receiving leather 57 and back leather 58, except for a hand inserting part 59, are sewn together so that grain sides of the both leathers face inward, and the sewn leathers are turned over so that the grain sides face outward. The surface leather has outer-side finger stalls including an outer-side thumb stall 51, an outer-side forefinger stall 52, an outer-side middle finger stall 53, an outer-side fourth finger stall 54 and an outer-side little finger stall 55.

The lining leather is obtained by sewing peripheral edges of the palm-side leather having a substantially five-finger shape and cut in a size smaller than that of the surface leather and the back leather obtained in such a manner that parts formed from a plurality of leathers so that five finger stalls are formed, except for a hand inserting part thereof, so that grain sides of the both leathers face inward. The lining leather has inner-side finger stalls including an inner-side thumb stall, an inner-side forefinger stall, an inner-side middle finger stall, an inner-side fourth finger stall and an inner-side little finger stall.

A core formed from felt or the like, a shock absorbing member, wax and the like are inserted into a predetermined part of the surface leather, and the predetermined part is impregnated with oil. Thereafter, the lining leather is inserted, and hand inserting parts 59 of the surface leather and the lining leather are joined with each other with a leather string. The respective inner-side finger stalls are inserted into the corresponding outer-side finger stalls. A web 56 separately formed is also joined with a leather string between outer-side thumb stall 51 and outer-side forefinger stall 52. Then, the production of a main body of a glove 50 is completed.

Back leather 58, ball-receiving leather 57, back-side leather and palm-side leather can adopt natural leather, artificial leather, or any of materials having the same qualities as these leathers.

Next, the finger part stabilizing member is described. The finger part stabilizing member is provided in at least a region on both sides of a wearer's finger in a region in a periphery of the wearer's finger covering a root part through a fingertip part of the wearer's finger. The finger part stabilizing member may be provided in at least a region including a region on a palm side and a region on right and left sides of the wearer's finger in the region in the periphery of the wearer's finger so that the finger part stabilizing member is applied (fitted) to the wearer's finger. A shape of the finger part stabilizing member is appropriately adjusted to suitably fit a size of the inserted finger (width and length). In a preferable example of the present invention, it is necessary for a length of the finger part stabilizing member in a longitudinal direction thereof to be at least ½ of a length from the root part through the fingertip part of the finger, and it is necessary for a length of the finger part stabilizing member in a circumferential direction thereof to be a length corresponding to a length including the palm side and the right and left sides. The finger part stabilizing member is preferably applied (fitted) to the finger in at least the region including the region on the palm side and the region on the right and left sides of the wearer's finger. The finger part stabilizing member can be provided so that it can be applied (fitted) to a part or all of a back-of-hand side of the finger in addition to the foregoing region. Thereby, the glove can better fit the finger, and the finger can be thereby more appropriately held on the back-of-hand side of the wearer's finger in addition to the palm side and the right and left sides. The finger part stabilizing member can be further extended so as to include a part along the wearer's palm part in addition to the foregoing part. Thereby, the impact from the ball when the ball is caught can be alleviated.

The finger part stabilizing member is provided so as to reach into at least one of the inner-side finger stalls, which are the inner-side thumb stall, inner-side forefinger stall, inner-side middle finger stall, inner-side fourth finger stall and inner-side little finger stall in the main body of the glove. The finger part stabilizing member is preferably provided in the inner-side forefinger stall and the inner-side middle finger stall in consideration of the impact from the ball when the ball is caught and an appropriate grip strength to be exerted when the ball is caught.

The finger part stabilizing member can adopt natural leather, artificial leather, or any of materials having the same qualities as these leathers. The finger part stabilizing member is formed separately from the main body of the glove, and thereafter, integrated into the main body of the glove by means of sewing or bonding.

When the finger part stabilizing member is provided in the inner-side finger stall in the main body of the glove, the finger assisted by the finger part stabilizing member can be firmly held, and the glove can thereby fit the hand in the same manner as gloves in general worn by hands fit the hands. Then, the force can be smoothly transmitted from the hand to the glove. As a secondary effect, the impact from the ball when the ball is caught can be alleviated. In the case where the finger part stabilizing member is provided in the inner-side forefinger stall and the inner-side middle finger stall, a remarkable effect can be obtained in the efficient transmission of the force of the finger when the ball is thereby grabbed to the glove, and the alleviation of the impact from the ball when the ball is caught. Further, in the case where the finger part stabilizing member includes a part or all of the region on the back-of-hand side, the finger can be more tightly fitted into the glove. In the case where the finger part stabilizing member includes the part along the wearer's palm part, the hand can be more appropriately fitted into the glove, and the impact from the ball when the ball is caught by the palm part can be alleviated.

EXAMPLES

Figure 1:
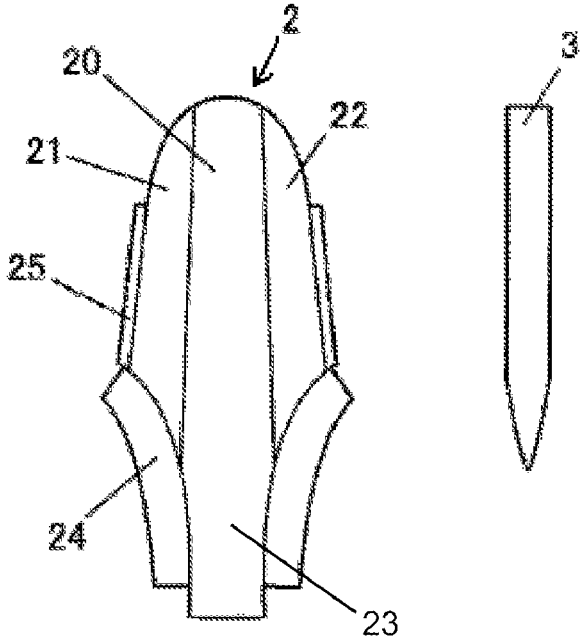
FIG. 1 is an exploded view of a member used for a finger part stabilizing member according to an example of the present invention.
Figure 2:
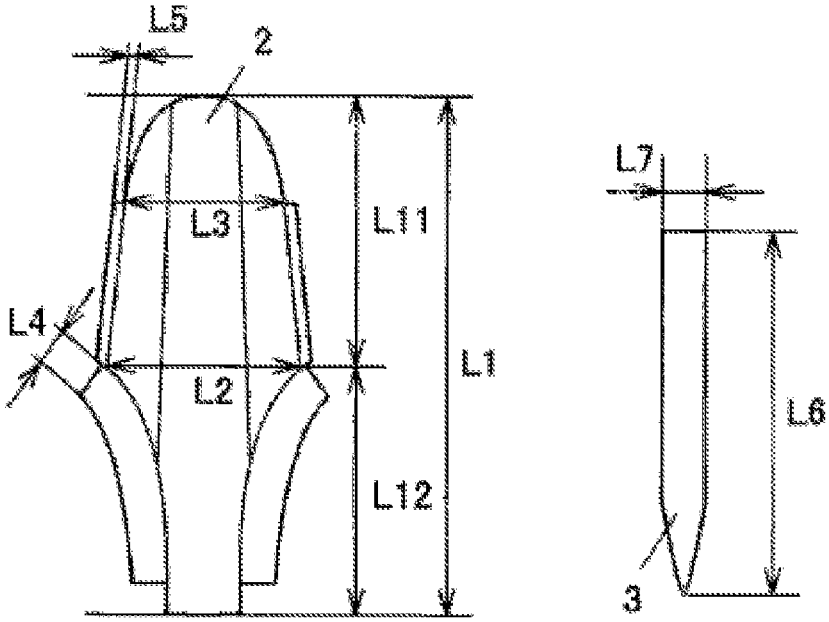
FIG. 2 is an illustration of respective dimensions of the finger part stabilizing member shown in FIG. 1.
Figure 3:
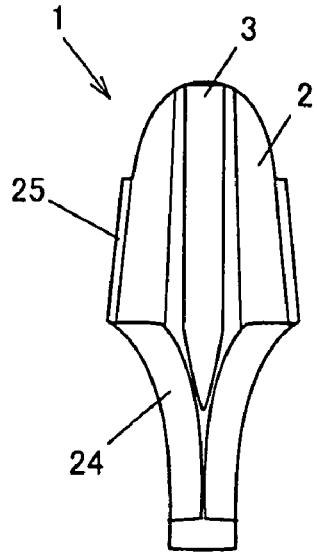
FIG. 3 shows a state where a part of the member shown in FIG. 1 is bonded.
Figure 4:
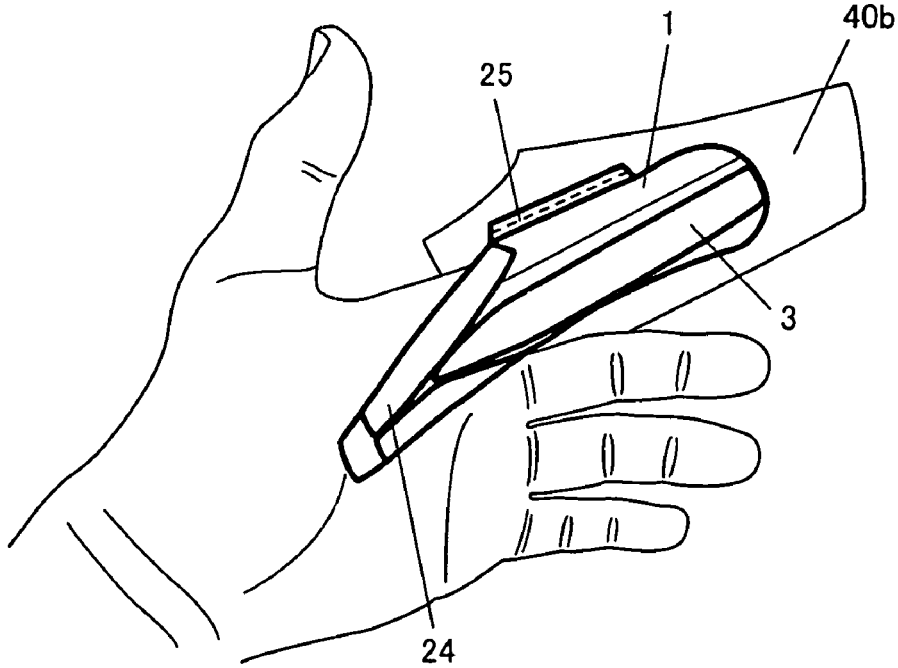
FIG. 4 shows a state where the finger part stabilizing member and a back-side leather of a forefinger part which are sewn together is worn by a forefinger of a left hand.
Figure 5:
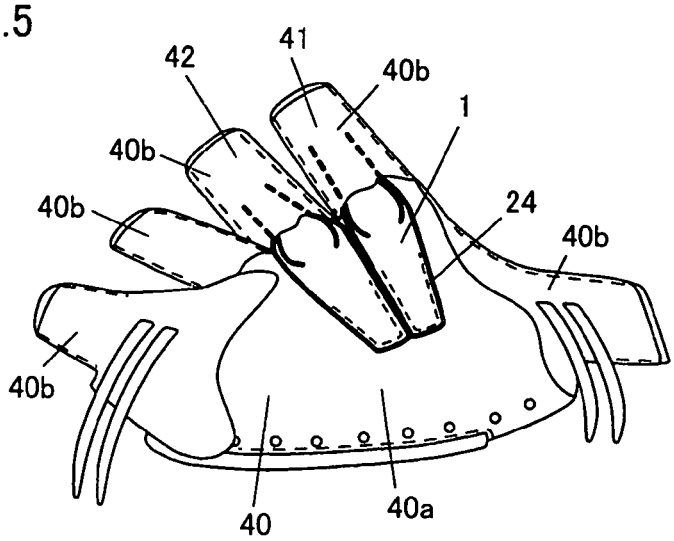
FIG. 5 shows a lining leather in which the finger part stabilizing member is sewn to an inner-side forefinger stall and an inner-side middle finger stall.

Below are described examples. FIG. 1 is an exploded view of a member used for a finger part stabilizing member according to an example of the present invention. FIG. 2 is an illustration of respective dimensions of the finger part stabilizing member shown in FIG. 1. FIG. 3 shows a state where a part of the member shown in FIG. 1 is bonded. FIG. 4 shows a state where the finger part stabilizing member and a back-side leather of a forefinger part which are sewn together is worn by a forefinger of a left hand. FIG. 5 shows a lining leather in which the finger part stabilizing member is sewn to an inner-side forefinger stall and an inner-side middle finger stall.

A finger part stabilizing member 1 according to the example can be provided in the lining leather in glove 50 shown in FIGS. 14 and 15, and includes a main member 2 and an auxiliary member 3 as shown in FIG. 1. Main member 2 includes a palm part 20 applied to the palm side of the finger, a left-side part 21 applied to the left side, a right-side part 22 applied to the right side, an extended part 23 applied to the palm part, first seam allowances 24 provided on right and left sides of the extended part, and second seam allowances 25 provided on outer sides of the right-side and left-side parts. Auxiliary member 3 has a substantially rectangular shape and is gradually narrowed in width at a lower-end part thereof.

Referring to the dimensions of the respective parts, as shown in FIG. 2, a vertical length L1 of main member 2 is 130 mm (a length L11 of the palm part is 70 mm, and a length L12 of the extended part is 60 mm). Referring to horizontal lengths, a root part L2 of the finger is 50 mm, an edge part L3 at the second seam allowance is 40 mm, a width L4 of the first seam allowance is 10 mm, and a width L5 of the second seam allowance is 3 mm. A vertical length L6 of auxiliary member 3 is 95 mm, and a horizontal length L7 thereof is 10 mm.

Next, as shown in FIG. 3, auxiliary member 3 is bonded to a central part of main member 2 in the vertical direction so that upper ends thereof flush with each other, and first seam allowances 24 are folded back and bonded to a main body of the main member to be engaged therewith. Auxiliary member 3 is provided at the central part of main member 2 in the vertical direction so that the glove can better fit the hand, the finger can be more appropriately held, and a shock absorptivity can be improved. The finger part stabilizing member 1 thus constituted is sewn to the lining leather of the glove main body to be attached thereto, wherein first seam allowances 24 are used for the sewing with respect to the palm leather, and second seam allowances 25 are used for the sewing with respect to the back-side leather. FIG. 4 shows a state where second seam allowances 25 of finger part stabilizing member 1 are sewn to a back-side leather 40*b* of the forefinger stall.

Describing steps of attaching finger part stabilizing member 1 to the lining leather, first, second seam allowances 25 of finger part stabilizing member 1 are sewn to the back-side leather 40*b*, and then, back-side leather 40*b* and a palm-side leather 40*a* are sewn together so that a lining leather 40 is formed, and finally, first seam allowances 24 of finger part stabilizing member 1 are sewn to palm-side leather 40*a*.

In the lining leather, palm-side leather 40*a* cut in the size smaller than that of the surface leather and having the substantially five-finger shape and back-side leather 40*b* having the shape corresponding to the five fingers are sewn together so that grain sides thereof face inward. Thereby, the inner-side thumb stall, inner-side forefinger stall, inner-side middle finger stall, inner-side fourth finger stall, and inner-side little finger stall are formed. In the present example, finger part stabilizing member 1 is sewn to an inner-side forefinger stall 41 and an inner-side middle finger stall 42 of lining leather 40 to be attached thereto as shown in FIG. 5.

The lining leather including the finger part stabilizing members thus formed is inserted into the surface leather separately formed from the back leather and the ball-receiving surface leather. Then, the glove according to the present example is provided.

The shapes and the dimensions of the finger part stabilizing member mentioned above are mere examples, and can be adjusted to be suitable to the size (width and length) of the wearer's finger.

Figure 6:
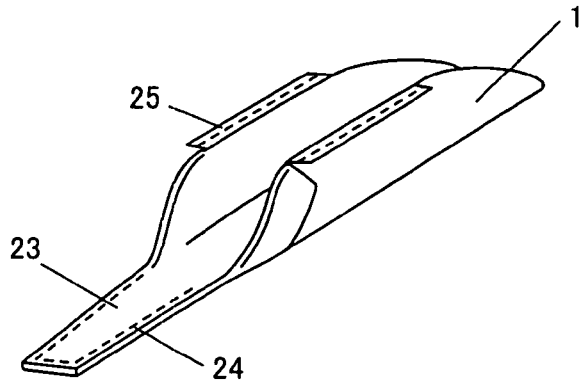
FIG. 6 is a perspective view of the finger part stabilizing member according to the example of the present invention.

Next, the shapes of finger part stabilizing members 1 shown in FIGS. 1-5 are described in further detail referring to FIG. 6, and other examples of finger part stabilizing member 1 are described referring to FIGS. 7-13.

As shown in FIG. 6, any of finger part stabilizing members 1 shown in FIGS. 1-5 preferably has a pair of wall parts provided on right and left sides of the wearer's finger. The wall parts are typically provided to start from back-side leather 40*b* and finally reach palm-side leather 40*a* in the respective inner-side finger stalls so that a space into which the wearer's finger can be inserted is defined in the respective inner-side finger stalls.

In the example shown in FIG. 6, finger part stabilizing member 1 has a palm part for connecting lower end parts (another ends) of the pair of wall parts, however, the palm part can be omitted. In the case where the palm part is omitted, both end parts of the pair of wall parts in the vertical direction are preferably fixedly bonded to palm-side leather 40*a* and back-side leather 40*b* (for example, by means of sewing, bonding, or the like).

In finger part stabilizing member 1 shown in FIG. 6, upper end parts (one ends) of the pair of wall parts are bended so that second seam allowances 25 are provided. Finger part stabilizing member 1 is sewn to back-side leather 40*b* at second seam allowances 25. Further, finger part stabilizing member 1 shown in FIG. 6 has extended part 23 which is the part along the wearer's palm, and first seam allowance 24 is provided on peripheral end parts of extended part 23. Finger part stabilizing member 1 is sewn to palm-side leather 40*a* at first seam allowance 24. More specifically, in finger part stabilizing members 1 shown in FIGS. 1-6, the part of finger part stabilizing member 1 on the side of back-side leather 40*b* is fixedly bonded to back-side leather 40*b*, while the part of finger part stabilizing member 1 on the side of palm-side leather 40*a* is fixedly bonded to palm leather 40*a*. Finger part stabilizing member 1 may be provided only inside the inner-side finger stall in the lining leather, or may be provided in the inner-side finger stall so that a part thereof is exposed out of the inner-side finger stall.

Figure 7:
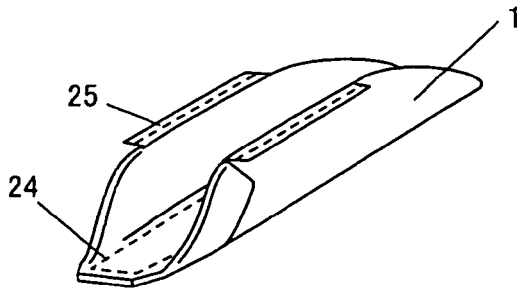
FIG. 7 is a perspective view of a finger part stabilizing member according to another example of the present invention.

As shown in FIG. 7, extended part 23 may be omitted, in which case first seam allowances 24 are provided on peripheral edge parts of the palm part of finger part stabilizing member 1. Any other part of the constitution shown in FIG. 7 is similar to that of the finger part stabilizing member 1 shown in FIG. 6.

Figure 8:
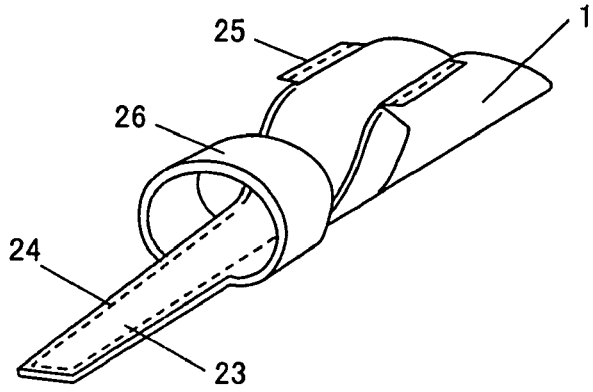
FIG. 8 is a perspective view of a finger part stabilizing member according to still another example of the present invention.

As shown in FIG. 8, finger part stabilizing member 1 may have a cylindrical (annular) part 26 in addition to the pair of wall parts. The wearer's finger can be inserted into cylindrical part 26. In the constitution wherein cylindrical part 26 is provided in addition to the pair of wall parts, the right and left sides of the wearer's finger can be supported at a plurality of points in a longitudinal direction of the finger when the wearer's finger is inserted into finger part stabilizing member 1. Therefore, the finger can be more firmly held, and the catching tool can be more comfortably fitted when the catching tool is worn.

In the example shown in FIG. 8, cylindrical part 26 is provided in extended part 23. Alternatively, cylindrical part 26 may be provided in such a manner that the upper end parts of the pair of wall parts are selectively connected. In other words, cylindrical part 26 and the pair of wall parts may be integrally formed. A cross sectional shape of cylindrical part 26 is not necessarily circular, but may have an arbitrary shape such as an elliptical shape or a rectangular shape.

As shown in FIG. 8, cylindrical part 26 and the pair of wall parts may be separately provided in the longitudinal direction of finger part stabilizing member 1. In such a case, an interval between cylindrical part 26 and the pair of wall parts can be arbitrarily selected. Further, as shown in FIG. 8, the pair of wall parts may be provided on the edge side of the wearer's finger, and cylindrical part 26 may be provided on the root side of the wearer's finger in comparison to the pair of wall parts, or the respective positions of cylindrical part 26 and the pair of wall parts may be reversed.

Further, in the example shown in FIG. 8, the one cylindrical part 26 is provided, however, a plurality of cylindrical parts 26 may be provided. An interval between the pair of wall parts and a diameter of cylindrical part 26 may be equal to each other, or may be different. In the case where the interval between the pair of wall parts and the diameter of cylindrical part 26 are different to each other, because the width of the finger is generally slightly different in the longitudinal direction thereof when observed from the back-of-hand side, the interval between the pair of wall parts and the diameter of cylindrical part 26 can be set in accordance with the variation of the width. For example, in the case where the pair of wall parts are provided on the edge side of the wearer' finger in comparison to cylindrical part 26, the diameter of cylindrical part 26 can set to be larger than the interval (maximum value) between the pair of wall parts because the finger width at the edge thereof is generally smaller than the finger width at the root part thereof. In that case, the wearer's finger can be smoothly inserted into finger part stabilizing member 1, and the finger can be thereby firmly held and more comfortably fitted into the catching tool when it is worn.

In the case of providing cylindrical part 26 and the pair of wall parts, they can be both provided in the inner-side finger stall, or at least one of them may be exposed out of the inner-side finger stall. In the example shown in FIG. 8, for example, at least a part of cylindrical part 26 may be exposed out of the inner-side finger stall, or cylindrical part 26 may be exposed out of the inner-side finger stall together with a part of the pair of wall parts. In the case where a part of the pair of wall parts is exposed out of the inner-side finger stall in the example shown in FIG. 8, the palm part which connects the lower end parts of the wall parts is also exposed out of the inner-side finger stall.

Figure 9:
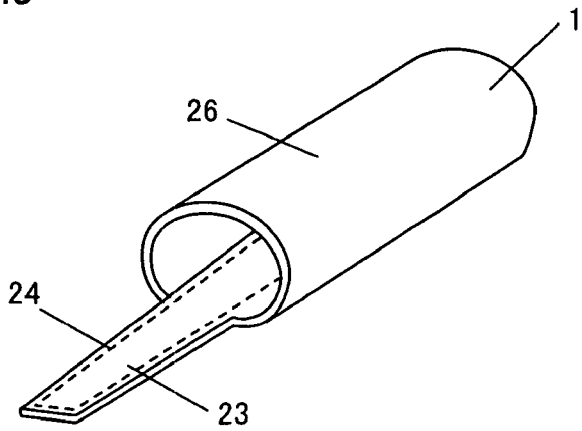
FIG. 9 is a perspective view of a finger part stabilizing member according to still another example of the present invention.

As shown in FIG. 9, cylindrical part 26 may be provided in place of the pair of wall parts shown in FIGS. 6 and 7. In this example, a part of cylindrical part 26 constitutes the pair of wall parts. Cylindrical part 26 shown in FIG. 9 may also be provided inside the inner-side finger stall, or a part of cylindrical part 26 may be exposed out of the inner-side finger stall. Further, the diameter of cylindrical part 26 may be changed. For example, the diameter of cylindrical part 26 can be changed in accordance with the variation of the width of the wearer's finger.

Figure 10:
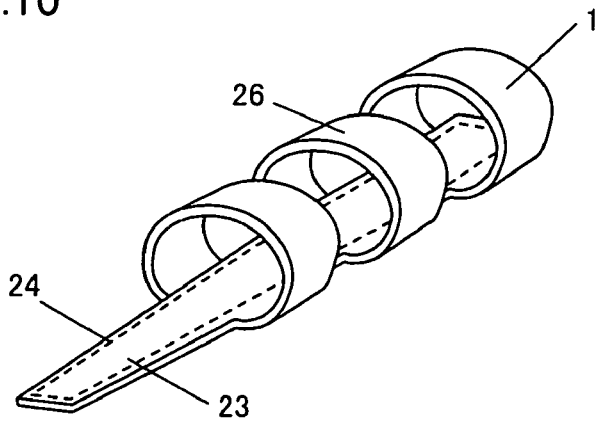
FIG. 10 is a perspective view of a finger part stabilizing member according to still another example of the present invention.

As shown in FIG. 10, a plurality of cylindrical parts 26 may be provided in finger part stabilizing member 1. In the example shown in FIG. 10 three cylindrical parts 26 are provided, however, the number of cylindrical parts 26 can be arbitrarily selected, and an interval between cylindrical parts 26 can be arbitrarily set. Further, in the example shown in FIG. 10, the diameter of each cylindrical part 26 can be changed in accordance with the variation of the width of the wearer's finger. All of cylindrical parts 26 may be provided inside the inner-side finger stall, or a part of cylindrical parts 26 may be exposed out of the inner-side finger stall.

Figure 11:
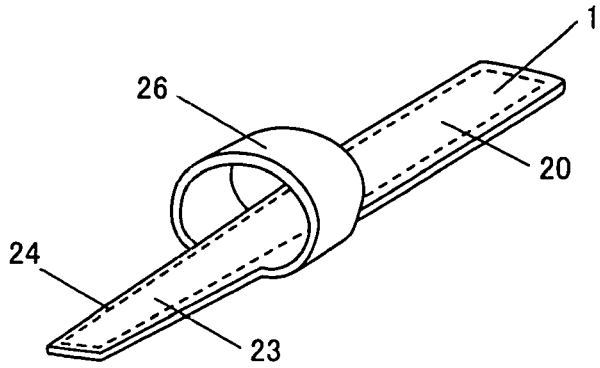
FIG. 11 is a perspective view of a finger part stabilizing member according to still another example of the present invention.

As shown in FIG. 11, cylindrical part 26 may be provided at a position distant from the end part of palm part 20 in the longitudinal direction thereof. For example, cylindrical part 26 can be provided at an intermediate part of palm part 20 in the longitudinal direction thereof, or in vicinity of extended part 23. In such a case, the intermediate part of the wearer's finger in the longitudinal direction thereof, the root part of the wearer's finger or a part of the finger in vicinity of the root part can be selectively retained or supported by cylindrical part 26 in a stable manner. In the example shown in FIG. 11, wherein cylindrical part 26 is provided at a position corresponding to the root part of the wearer's finger, the root part of the wearer's finger can be stably retained by cylindrical part 26.

Figure 12:
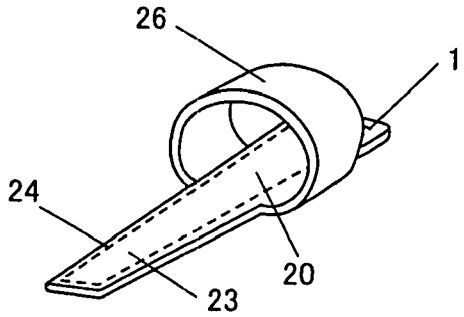
FIG. 12 is a perspective view of a finger part stabilizing member according to still another example of the present invention.

As shown in FIG. 12, the length of palm part 20 may be changed. Palm part 20 typically has such a length that can abut at least the palm side of the wearer's finger from the edge through the root thereof, however, the length of palm part 20 may be shorter than the foregoing typical length. In the example shown in FIG. 12, cylindrical part 26 is provided at the position corresponding to the root part of the wearer's finger, while palm part 20 is provided only at the root part of the wearer's finger and a position corresponding to the vicinity of the root part. Thereby, the root part of the wearer's finger can be stably retained by cylindrical part 26, and the root part of the wearer's finger and the palm-side part in vicinity of the root part can be supported by palm part 20.

Figure 13:
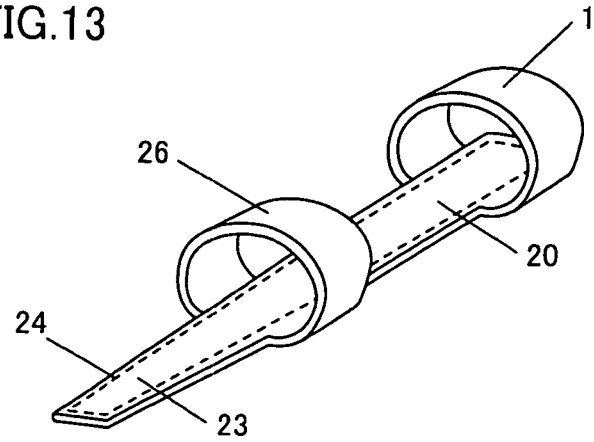
FIG. 13 is a perspective view of a finger part stabilizing member according to still another example of the present invention.

As shown in FIG. 13, cylindrical part 26 can be provided at the positions corresponding to the edge part of the wearer's finger and the root part of the wearer's finger. In such a case, the edge part and the root part of the wearer's finger can be stably retained or supported by cylindrical part 26.

The preferred embodiment and the examples were thus far described. The description of the specification is intended to cover such modifications that a part of the constitutions according to the preferred embodiment and the examples is omitted, and the constitutions according to the preferred embodiment and the examples are combined.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A catching tool for one of baseball and softball, in which a lining leather including at least a back-side leather and a palm-side leather is inserted into a surface leather including at least a back leather and a ball-receiving leather, the lining leather having inner-side finger stalls defined by peripheral edges of the back-side leather and the palm-side leather which are sewn together, wherein a finger part stabilizing member to be applied to a region including at least a palm side and right and left sides in a region covering a root part through a fingertip part of a wearer's finger is provided in at least one of the inner-side finger stalls, which include inner-side thumb stall, an inner-side forefinger stall, an inner-side middle finger stall, an inner-side fourth finger stall, and an inner-side little finger stall, wherein the finger part stabilizing member includes a main member having a palm part applied to the palm side of the finger, a left-side part applied to the left side of the finger, a right-side part applied to the right side of the finger, and an extended part applied to the palm part; and an auxiliary member provided at a central part of the main member in a vertical direction thereof and having a substantially rectangular shape.

* * * * *